United States Patent [19]

Failla et al.

[11] 4,288,016

[45] Sep. 8, 1981

[54] CORNER BEAD AND INSTALLATION TOOL

[75] Inventors: Stephen J. Failla, Chester, N.J.; Raymond S. Perry, Miami, Fla.

[73] Assignee: Plastic Components, Inc., Miami, Fla.

[21] Appl. No.: 96,307

[22] Filed: Nov. 21, 1979

[51] Int. Cl.[3] ..... B25C 1/02

[52] U.S. Cl. ..... 227/30; 52/254; 52/631; 227/152

[58] Field of Search ..... 227/30, 143, 152, 132, 227/146; 52/254, 261, 631

[56] References Cited

U.S. PATENT DOCUMENTS

| | | | |
|---|---|---|---|
| 686,254 | 1/1901 | Ganada | 52/254 |
| 2,540,106 | 2/1951 | Eichelberger | 227/152 |
| 2,720,651 | 10/1955 | Littman | 227/152 |
| 3,140,493 | 7/1964 | Ennis | 227/143 |
| 3,318,061 | 5/1967 | Stentz | 52/254 |
| 3,345,788 | 10/1967 | Holsman | 52/254 |
| 4,012,878 | 3/1977 | Ellingson | 52/254 |
| 4,126,259 | 11/1978 | Galen et al. | 227/152 |

*Primary Examiner*—Paul A. Bell

*Attorney, Agent, or Firm*—Harvey B. Jacobson

[57] ABSTRACT

A support for a pair of generally 90° relatively angulated staple guns is provided and the support defines a pair of aligned generally 90° V-shaped notches for embracingly engaging an outside dry wall corner structure. The inner portions of the V-shaped notches are relieved to receive a generally V-shaped corner bead therein and the notches are spaced apart to engage the corner bead at points spaced longitudinally therealong. The staple guns are spaced apart intermediate the V-shaped notches and include abutment surfaces from which staples may be projected, the abutment surfaces of the staple guns substantially coinciding with planes lying along and extending between corresponding sides of the notches. The staple guns include actuators shiftable between active and inactive positions and the support includes an operator shiftable along a path bisecting the included angle for operating the actuators. A V-shaped corner bead is provided including a partial cylindrical apex portion of generally 270° in angular extent and including tapering free longitudinal edge portions and projections extending longitudinally of and spaced transversely of the remote sides of the V-shaped corner bead.

11 Claims, 8 Drawing Figures

32
30
26
28
38
24
40
46
44
42
84
76
62
6
48
50
52
54
64
60
68
66
70
72
74
36
34

CORNER BEAD AND INSTALLATION TOOL

BACKGROUND OF THE INVENTION

Various forms of corner beads have been heretofore provided and one of the most popular forms includes pointed anchor tabs struck from and projecting inwardly of the adjacent sides of the corner bead into corresponding dry wall panels to form an outside dry wall corner construction. However, these corner beads are difficult to secure in proper position in order to obtain a straight corner and are constructed of lightweight bendable metal subject to bending and crimping as a result of rough handling. Accordingly, a need exists for an improved form of corner bead and an apparatus for installing the same.

Various forms of corner bead and similar structure installing tools are disclosed in U.S. Pat. Nos. 2,540,106 and 3,140,493.

BRIEF DESCRIPTION OF THE INVENTION

The corner bead of the instant invention comprises a V-shaped plastic corner bead whose opposite side flanges are integrally connected by a partial cylindrical apex portion of generally 270° angular extent. The side flanges of the corner bead include free marginal edge portions which taper outwardly toward their free longitudinal edges and the outer surfaces of the flanges of the V-shaped corner bead include outwardly extending projections spaced transversely of and extending longitudinally therealong and having openings formed therethrough and the underlying portions of the corresponding flanges.

The corner bead installation tool for installing the corner bead includes a support defining aligned V-shaped notches between which a pair of staple guns are supported and the staple guns include abutment surfaces from which staples may be projected, the abutment surfaces of the staple guns being disposed, generally, in planes lying along and extending between corresponding sides of the notches. The staple guns include actuators and the support includes an operator shiftable in a direction bisecting the included angle defined by the notches for operating the staple gun actuators.

The main object of this invention is to provide an improved corner bead for an outside corner dry wall construction.

Another object of this invention is to provide a corner bead whose construction will enable it to be reasonably roughly handled without permanent deformation.

Still another object of this invention is to provide a corner bead which will enable plaster to be more easily "skimmed" thereover to define a finished outside dry wall corner.

Another object of this invention is to provide a dry wall corner bead which may be more readily anchored in position in a manner defining a straight outside corner.

A still further object of this invention is to provide a corner bead to which plaster "skimmed" thereover may more readily adhere.

Another important object of this invention is to provide a corner bead installation tool which will be capable of securely anchoring the corner bead in position on an outside dry wall corner.

Still another object of this invention is to provide a corner bead installation tool which will enable equal attaching pressure to be simultaneously applied to opposite side longitudinally spaced portions of the corner bead.

Yet another object of this invention is to provide a corner bead installation tool which may be readily proficiently operated by inexperienced persons.

A final object of this invention to be specifically enumerated herein is to provide a corner bead and installation tool therefore which will conform to conventional forms of manufacture, be of simple construction and easy to use so as to provide devices which will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
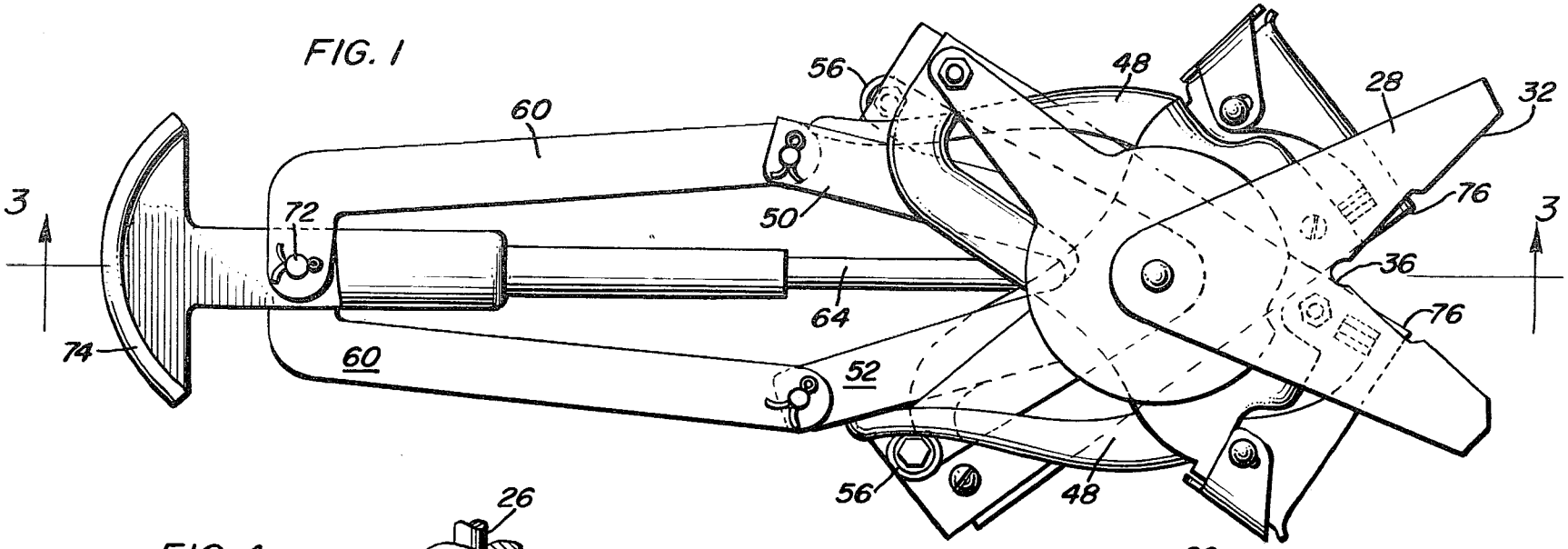
FIG. 1 is an end elevational view of the corner bead installation tool of the instant invention.
Figure 5:
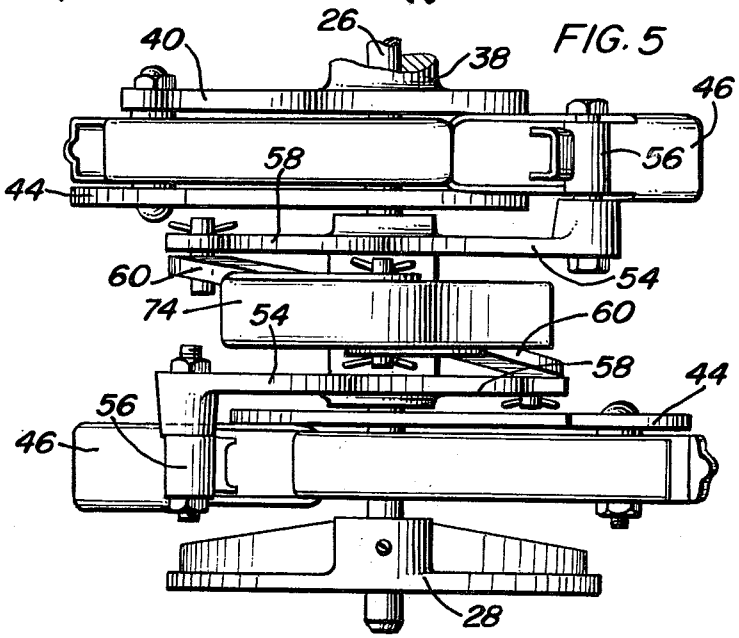
FIG. 5 is a fragmentary elevational view as seen from the left side of FIG. 3.
Figure 4:
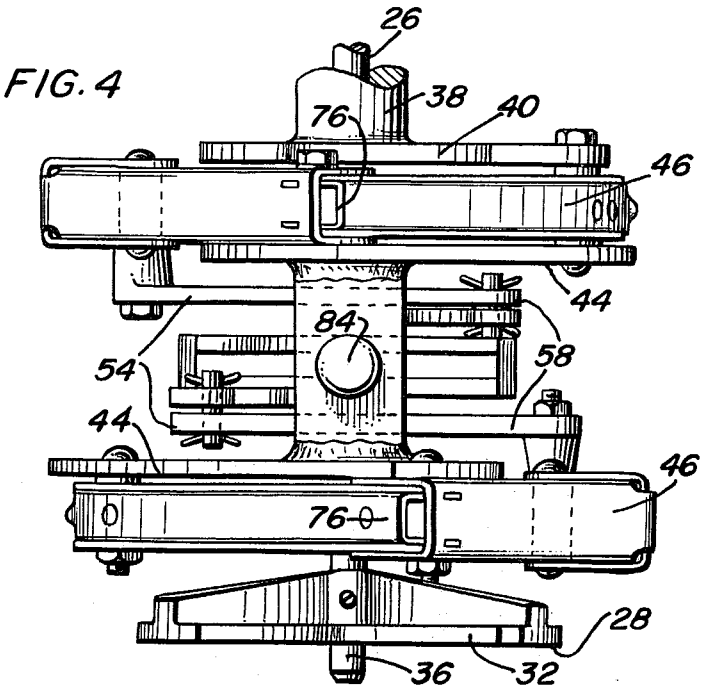
FIG. 4 is a fragmentary elevational view of the installation tool as seen from the right side of FIG. 3.

Referring now more specifically to the drawings, the numeral 10 generally designates a corner bead constructed in accordance with the present invention.

The prevelant type of corner bead in use today is made of thin gauge sheet steel, and is attached to the dry wall corner members by lancing the corner bead simultaneously in two places, one on each surface, by the use of sharp tools which lance and force wedge-like tabs of the sheet metal into the adjacent dry wall members. This lancing action is very similar to the action of a beer can opener as it lances and bends a pointed tab of a can lid down into the can. There are problems inherent with the metal corner beads themselves which this invention overcomes by the use of plastic corner beads. One of the problems inherent with metal corner beads is the tendency of the metal to rust and become unfit for use if exposed to moisture. Another problem of the steel corner bead is the tendency for it to bend or deform during handling, thus becoming unsuitable for use.

The corner bead of the instant invention offers additional advantages not available with metal corner beads. The corner bead 10 is constructed of plastic and includes longitudinal ridges 12 formed on and extending along its exterior surfaces. The ridges 12 are spaced inwardly of the free longitudinal edges of the corner bead flanges 14 and the free longitudinal marginal edges of the flanges 14 are tapered as at 16. These ridges 12 serve as "anchors" for securely attaching the "skim" plaster to the corner beads and the flanges 14 each also include bores or passages 18 formed therethrough at points spaced transversely and longitudinally thereof. The bores 18 additionally serve to enhance the adhesion of "skim" plaster to the corner beads and also assist in anchoring the "skim" plaster to the underlying dry wall panels. Further, the tapered outer longitudinal marginal edges 16 of the flanges 14 enable the "skim" plaster to more readily cover the joint between the free edges of the flanges 14 and the adjacent dry wall sections. The corner bead 10 may be readily extruded and the portions punched therefrom after extrusion in order to form the bores 18 may be readily recycled.

A basic form of plastic corner bead was introduced years ago, but did not include the tapered outer marginal edge portion 16 of the flanges 14, the ridges 12 or the bores 18. Additionally, this older form of plastic corner bead was stapled into position, but individually stapling the two flanges of the plastic corner bead resulted in uneven stapling, flexure of the corner bead and generally required the utilization of a supplementary straight edge while being stapled.

Also, the older plastic corner bead did not include the partial cylindrical apex portion 20 of the corner bead of the instant invention. The partial cylindrical apex portion 20 is of generally 270° in angular extent and projects outwardly beyond the outer surfaces of the ridges 12 whereby the "skimming" plaster to finish desired outside dry wall corner construction may be trowelled level with planes tangent to the apex portion 20 and substantially coextensive with the corresponding dry wall surfaces.

The corner bead installation tool of the instant invention is referred to in general by the reference numeral 24 and includes an elongated rod support 26 upon whole opposite ends substantially mirror image abutment members 28 are releasably secured by set screws 30. The abutment members 28 define spaced registered notches 32 and the inner portions of the notches 32 are relieved as at 34. In addition, the apex portions of the notches 32 include partial cylindrical cutouts 36, the relieved portions 34 being provided to seatingly receive the flanges 14 and the cutouts 36 being provided to establish clearance for the apex portion 20 of the corner bead 10.

One end portion of the rod 26 has a tubular handle 38 disposed thereon including a mounting flange portion 40, a center support member 42 is mounted on the other end portion of the rod 26 and supports a pair of mounting flange portions 44 and a pair of staple guns 46 are supported from the mounting flange portions 40 and 44 with one of the guns 46 being supported between the mounting flange portion 40 integral with the tubular handle 38 and the adjacent mounting flange portion 44 supported from the center support member 42 and the other staple gun 46 being mounted on the outer side of the mounting flange portion 44 remote from the mounting flange portion 40. Each of the staple guns 46 includes a lever type actuator 48 shiftable between active and inactive positions and a pair of bell cranks 50 and 52 are oscillatably mounted on the rod 26 between opposite side portions of the center support member 42 and the opposing mounting flange portions 44. The bell cranks 50 and 52 include first arms 54 equipped with lateral rollers 56 engaged with the actuators 48 and second arms 58 to whose free ends corresponding ends of a pair of connecting links 60 are pivotally connected. The center support member 42 includes a blind bore 62 opening outwardly therefrom in a direction opposite to the direction in which the notches 32 open and one end of a guide shaft 64 is anchored within the bore 62. A tubular actuator plunger 66 is telescoped over the end of the shaft 64 and has a compression spring 68 seated therein engaged with the outer end of the shaft 64. The outer end of the shaft 64 mounts an end structure 70 and the ends of the connecting links 60 remote from the arms 58 are pivotally anchored, as at 72, to the end structure 70. The structure 70 includes an endwise outwardly facing hand engageable abutment member 74 by which hand or palm pressure may be applied inwardly along the actuator portion 66 twoard the center support member 42.

The staple guns 46 comprise conventional staple guns (although they may comprise other types of fastener guns) wherein the actuators 48 thereof are oscillatable between active and inactive positions and the staple guns 46 further include abutment surfaces 76 from which staples may be ejected and which are disposed, generally, in planes lying along and extending between corresponding sides of the notches 32.

Figure 2:
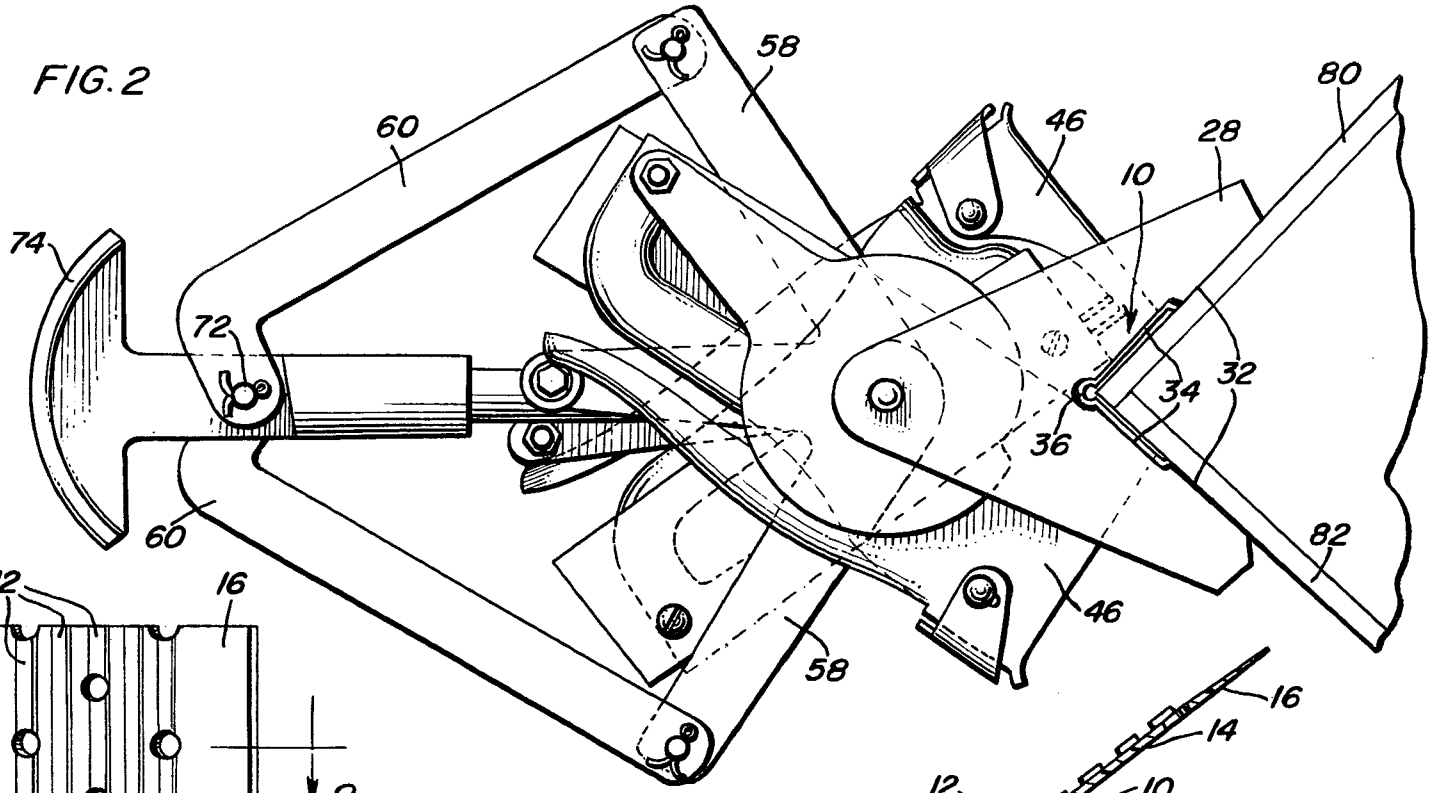
FIG. 2 is an end elevational view similar to FIG. 1, but with the shiftable components of the installation tool in position thereof to project staples therefrom in the process of stapling a corner bead to an outside dry wall corner.
Figure 8:
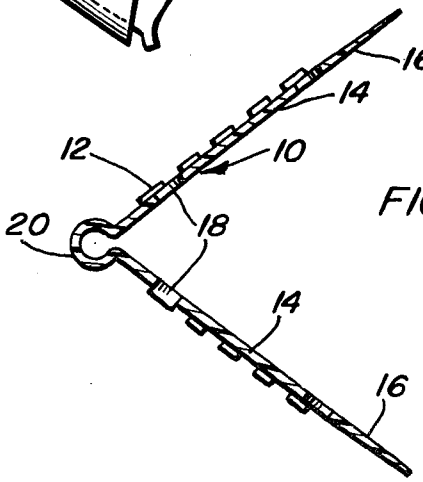
FIG. 8 is a sectional view taken substantially upon the plane indicated by the section line 8—8 of FIG. 7.
Figure 7:
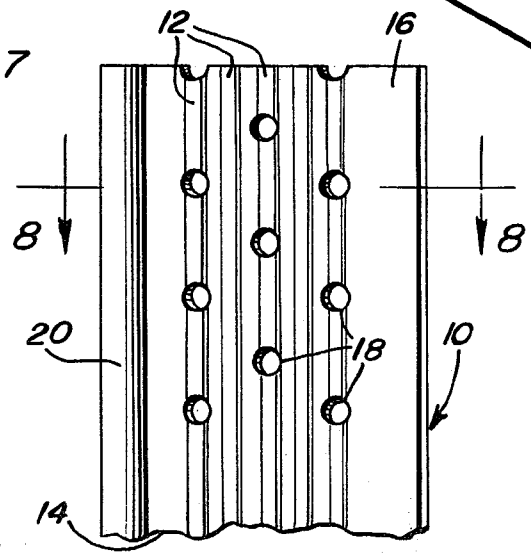
FIG. 7 is a fragmentary elevational view of a corner bead constructed in accordance with the present invention.
Figures 3, 6:
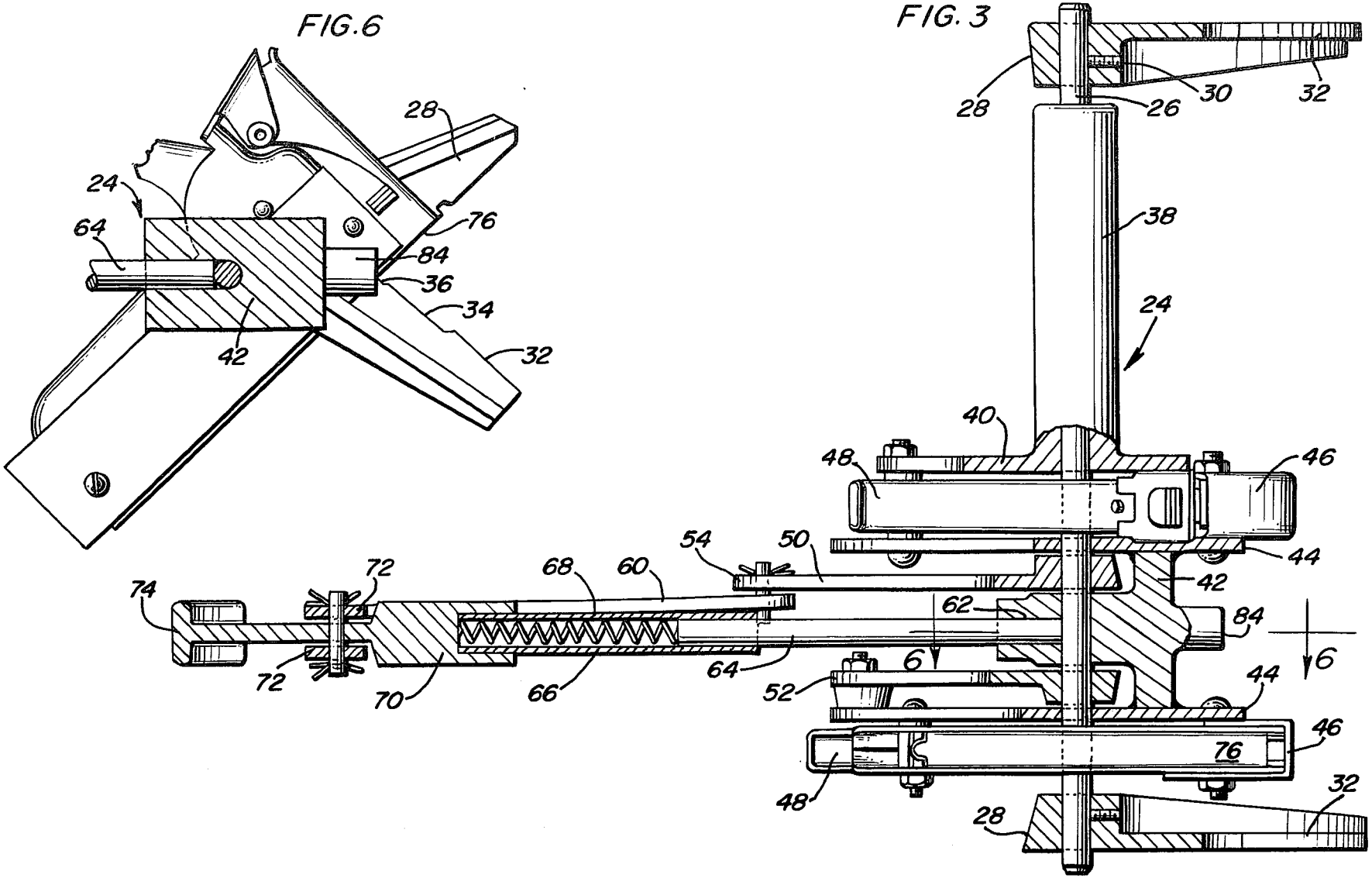
FIG. 3 is a fragmentary longitudinal vertical sectional view taken substantially upon a plane indicated by section line 3—3 of FIG. 1.
FIG. 6 is a fragmentary sectional view taken substantially upon the plane indicated by the section line 6—6 of FIG. 3.

From a comparison of FIGS. 1 and 2 of the drawings, it may be see that when the abutment member 74 is displaced inwardly relative to the shaft 64 from the position thereof illustrated in FIG. 1 of the drawings to the position thereof illustrated in FIG. 2 of the drawings the actuators 48 are angularly displaced from their inactive positions to their active positions as a result of the angular displacement of the bell cranks 50 and movement of the rollers 56 along the outer sides of the actuators 48. As the actuators 48 reach their active positions, the staple guns 46 are operated to eject staples from the abutment surfaces 76 and into and through the tapered free longitudinal edge portions 16 of the corner bead 10. Inasmuch as staples are substantially simultaneously projected from the abutment surfaces 76 through the longitudinal marginal portions 16, a corner bead 10 positioned as illustrated in FIG. 2 of the drawings to complete the outside corner construction formed by a pair of dry wall panels 80 and 82, is properly secured in position. The corner bead, by being seated in the relieved areas 34 of the notches 32, is properly in position to form the desired corner construction.

The center support member 42 further includes an abutment 84 engageable with the apex portion 20 of the corner bead 10 in a location thereon spaced between those portions of the corner bead 10 which are received in and engaged by the surfaces of the abutment members 28 defining the notches 32. Accordingly, it may be seen that a corner bead 10 may be readily secured in position merely by placing the installation tool 24 against the corner bead and thereafter inwardly displacing the abutment member 74 of the tool 24 several times as the tool 24 is moved downwardly along the corner bead.

Of course, various different forms of staple guns 46 may be supported from the installation tool 24 and if other forms of staple guns 46 are to be utilized in conjunction with the installation tool 24 and include actuators therefor which are different from the actuators 48, the tool 24 may be modified whereby the actuators of such other staple guns 46 may be substantially simultaneously operated by inward movement of the abutment member 74. Further, other types of actuators independent of such "inward movement" may be used. Also, more than two staple guns may be provided.

The corner bead 10 is constructed of plastic and, therefore, need not be handled with great care in order to prevent damage thereto either before or after installation. Further, the corner bead 10 will be uneffected by moisture and the ribs 12 and bores 18 formed in the flanges 14 of the corner bead 10 will assist in enabling the "skim" plaster to adhere to the corner bead and also the underlying portions of the dry wall panels 80 and 82.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A corner bead installation tool including an elongated support having longitudinally spaced abutment structures defining registered generally V-shaped notches opening outwardly alongside of said support and adapted to abut the outer surfaces of the flanges of a corner bead extending along said support and having its apex portion seated in said notches, a pair of fastener guns mounted on said support and including abutment surfaces thereof from which fastener may be ejected, said abutment surfaces being disposed, generally, in planes lying along and extending between corresponding sides of said notches, said fastener guns each including an actuator shiftable between active and inactive positions and means operative in response to shifting of said actuators to said active positions to eject fasteners from said abutment surfaces in directions generally normal thereto, operator means shiftably supported from said support and operative to substantially simultaneously shift said actuators toward said active positions in reponse to shifting to the operator means.

2. The combination of claim 1 wherein said operator means is shiftable along a path generally bisecting said notch and in the direction in which said notches open during movement to shift said actuators toward said active positions.

3. The combination of claim 1 wherein said support includes an abutment spaced between said notches and said fastener guns, facing in the direction in which said notches open and projecting slightly through a line connecting the apex portions of said notches.

4. The combination of claim 1 wherein said notches include inner relieved portions thereof in which to seatingly receive a V-shaped corner bead in a substantially recessed and flush position relative to said notches.

5. The combination of claim 1 including a generally V-shaped corner bead for dry walls, said corner bead including a pair of elongated generally right angulated flanges joined together along adjacent longitudinal marginal edge portions by a partial cylindrical apex portion integral with said fanges, said apex portions being generally 270° in angular extent and disposed at least substantially entirely outwardly of the included angle defined by said corner bead, the remote longitudinal marginal edge portions of said flanges tapering toward their free longitudinal edges, said bead being seatingly receivable within said notches and with said remote longitudinal marginal edge portions of said flanges having said abutment surfaces of said fastener guns registered therein.

6. The combination of claim 5 wherein said notches include inner relieved portions thereof in which said V-shaped corner bead is received in a substantially recessed and flush position relative to said notches.

7. The combination of claim 6 wherein said apex portions of said notches include partial cylindrical cutouts in which said partial cylindrical apex portion is seatingly received.

8. The combination of claim 5 wherein the remote sides of said flanges include short outwardly extending projections spaced thereover.

9. The combination of claim 8 wherein said projections and the underlying portions of said flanges having openings formed therethrough extending generally normal to the corresponding flanges.

10. The combination of claim 9 wherein the corner bead is constructed of plastic.

11. The combination of claim 1 wherein said fastener guns are mounted on said support at points spaced therealong.

* * * * *